US007661397B2

(12) United States Patent
Lehmann et al.

(10) Patent No.: US 7,661,397 B2
(45) Date of Patent: Feb. 16, 2010

(54) HYDRAULIC CAMSHAFT ADJUSTER AND METHOD FOR ASSEMBLING THE SAME

(75) Inventors: Kai Lehmann, Ludwigsfelde (DE); Michael Scheele, Berlin (DE)

(73) Assignee: Daimler AG, Stuttgart (DE)

( * ) Notice: Subject to any disclaimer, the term of this patent is extended or adjusted under 35 U.S.C. 154(b) by 334 days.

(21) Appl. No.: 11/592,730

(22) Filed: Nov. 3, 2006

(65) Prior Publication Data

US 2007/0095317 A1 May 3, 2007

Related U.S. Application Data

(63) Continuation-in-part of application No. PCT/EP2005/004624, filed on Apr. 29, 2005.

(30) Foreign Application Priority Data

May 5, 2004 (DE) ..... 10 2004 022 097

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 6,450,137 B2 * 9/2002 Ogawa ..... 123/90.17
2001/0015185 A1 8/2001 Ogawa
2002/0139332 A1 10/2002 Takenaka

FOREIGN PATENT DOCUMENTS

| | | |
|---|---|---|
| DE | 102 17 062 | 10/2002 |
| DE | 101 50 856 | 4/2003 |
| DE | 102 53 496 | 9/2003 |
| DE | 10 2004 038 655 | 3/2005 |
| EP | 1 008 729 | 6/2000 |
| JP | 2000 179310 | 6/2000 |

* cited by examiner

*Primary Examiner*—Ching Chang
(74) *Attorney, Agent, or Firm*—Klaus J. Bach

(57) ABSTRACT

In a hydraulic camshaft adjuster for a camshaft of an internal combustion engine and a method of assembling the camshaft adjuster including an inner body, which is connected to the camshaft in a rotationally fixed manner and has outwardly extending blades and an outer body which has inwardly projecting blades which form, together with the outwardly extending blades, at least one hydraulic medium chamber between two housing side covers connected to the outer body and operatively connected to a crankshaft of an engine so as to be driven thereby, a locking bolt is provided for locking the inner body in relation to the outer body with a predetermined play.

14 Claims, 5 Drawing Sheets

HYDRAULIC CAMSHAFT ADJUSTER AND METHOD FOR ASSEMBLING THE SAME

This is a Continuation-in-Part Application of pending international patent application PCT/EP2005/004624 filed Apr. 29, 2005 and claiming the priority of German patent application 10 2004 022 097.2 filed May 5, 2004.

BACKGROUND OF THE INVENTION

The invention relates to a hydraulic camshaft adjuster and to a method of assembling the same for a camshaft of an internal combustion engine, comprising an inner body, which is connected to the camshaft in a rotationally fixed manner and has outwardly extending blades and an outer body, which is mounted rotatably relative to the camshaft and has blades extending inwardly between the outwardly extending blades so as to form at least one hydraulic medium chamber between two opposite cover plates, a driving connection from a crankshaft to the outer body, and with a locking device which locks the inner body in relation to the outer body with at least one bolt, which is movably disposed in the inner body for engagement in a locking cavity in one of the two covers, which are connected to the outer body.

In order to reduce the fuel consumption and the emissions and to increase power and torque, spark-ignition engines are generally equipped with camshaft adjusters. The latter change the phase position of the camshaft relative to the crankshaft. Currently, hydraulic blade-type adjusters with working chambers are generally used. The adjustment is undertaken by the controlled admission of oil from the engine circuit via a control valve into the chambers formed between adjacent blades. The control valve is operated by an electromagnetic control device.

DE 102 53 496 A1 discloses a camshaft adjuster of the generic type and is intended for adjusting the angle of rotation of the camshaft in relation to a crankshaft of an internal combustion engine. The camshaft adjuster has an outer body which is connected in a rotationally fixed manner to a drive wheel and an inner body which is connected in a rotationally fixed manner to the camshaft, the outer body having at least one hydraulic chamber and the inner body having at least one rotor blade which divides the hydraulic chamber into two working chambers. The rotor blade can be moved hydraulically between a late stop and an early stop by means of a controlled oil pressure. One of the stops forms the base position in which the blade can be locked by means of a spring-loaded locking pin which can be released hydraulically and which is moved into a locking groove or bore for locking purposes. The locking pin prevents an undesired movement of the camshaft adjuster if no oil pressure is present. These locking pins have a locking play in the locking grooves caused by the sum of the tolerances, some play being necessary for reliable functioning of the lock. The locking play should be large enough such that reliable locking and release operation can be obtained, but small enough to avoid the generation of noise. The generation of noise results from the undamped striking contact of a rotor blade and early stop or late stop, on the one hand, and the locking pin entering the locking groove, on the other hand. The aim of obtaining a quiet engine and a reliably operating lock can generally only be achieved by means of an exacting tolerance of the locking play. However, this exacting tolerance not only has technological limits for adjusting the locking play but moreover monitoring this adjusting operation by continuously measuring the locking play is very costly.

It is the principle object of the present invention to provide a hydraulic camshaft adjuster and a method for assembling the same in such a manner that reliable assembling of the camshaft adjuster with minimal locking play and without an adjusting process is possible.

SUMMARY OF THE INVENTION

In a hydraulic camshaft adjuster for a camshaft of an internal combustion engine and a method of assembling the camshaft adjuster, with an inner body, which is connected to the camshaft in a rotationally fixed manner and has outwardly extending blades and an outer body which is mounted rotatably with respect to the camshaft and has inwardly projecting blades which form, together with the outwardly extending blades, at least one hydraulic medium chamber between two covers connected to the outer body which is operatively connected to a crankshaft of an engine so as to be driven thereby, and a locking device for locking the inner body in relation to the outer body by at least one bolt which is mounted in the inner body so as to extend into a locking cavity in one of the two covers, the camshaft adjuster has a base stop, and the locking cavity has an assembly stop providing for reliable assembly of the camshaft adjuster with minimal locking play and without the need for an adjusting procedure.

A substantial advantage of the camshaft adjuster according to the invention is that an adjusting device for adjusting the locking play between the bolt and the locking cavity is not necessary for the assembly of the camshaft adjuster. Even minimal locking plays can be reliably provided. The shape of the cavity depends on the result to be achieved. The shape may be a bore for simple manufacture. The shape of the cavity may also be designed in such a manner that the stop edges of the base stop and installation stop point radially with respect to the axis of rotation of the camshaft adjuster in order, in the case of larger radial tolerances, to provide the same locking plays. The shape of the cavity may be designed in such a manner that both stop edges are parallel to each other and possibly also parallel to a virtual line extending radially with respect to the axis of rotation of the camshaft adjuster in order to permit the use a simple gauge test for quality assurance.

The invention will become more readily apparent from the following description of two exemplary embodiments with reference to the accompanying drawings:

DESCRIPTION OF THE PARTICULAR EMBODIMENTS

For the sake of simplicity, the same reference numbers are used for corresponding components in the figures. Furthermore, for identical components, only one element in each case is indicated as an example.

Figure 3:
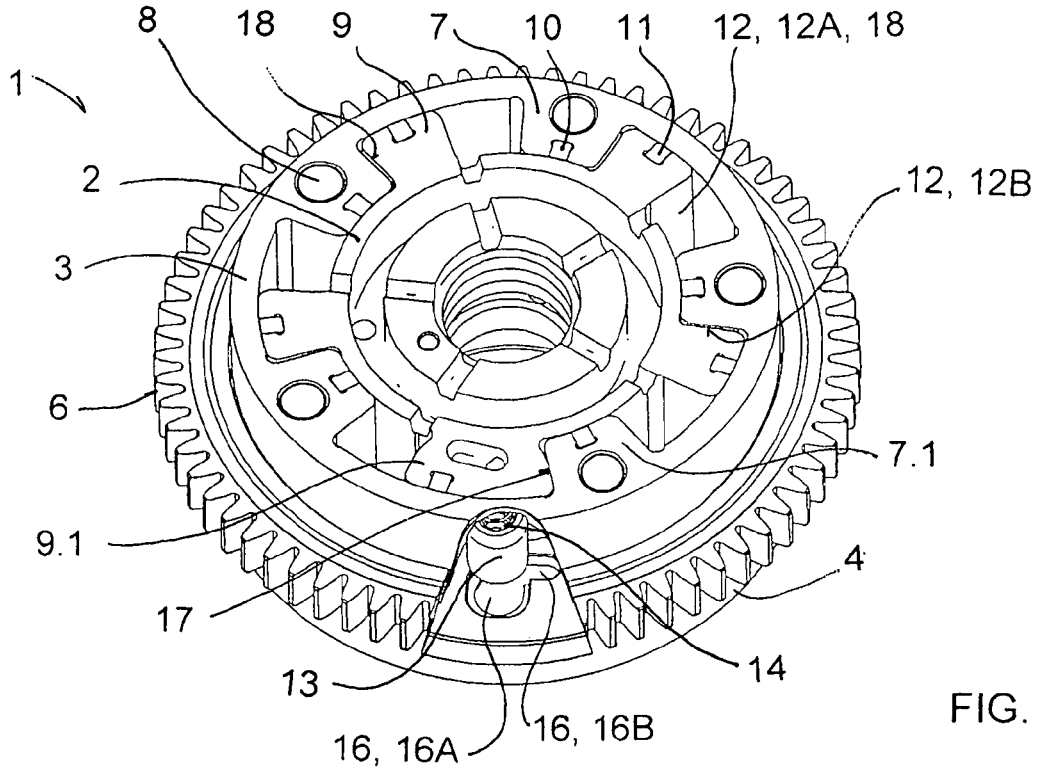
FIG. 3 shows the camshaft adjuster according to FIG. 2 in a view from below, in which, by rotation of the drive wheel, the bolt is introduced into a cavity formed in the drive wheel.
Figure 4:
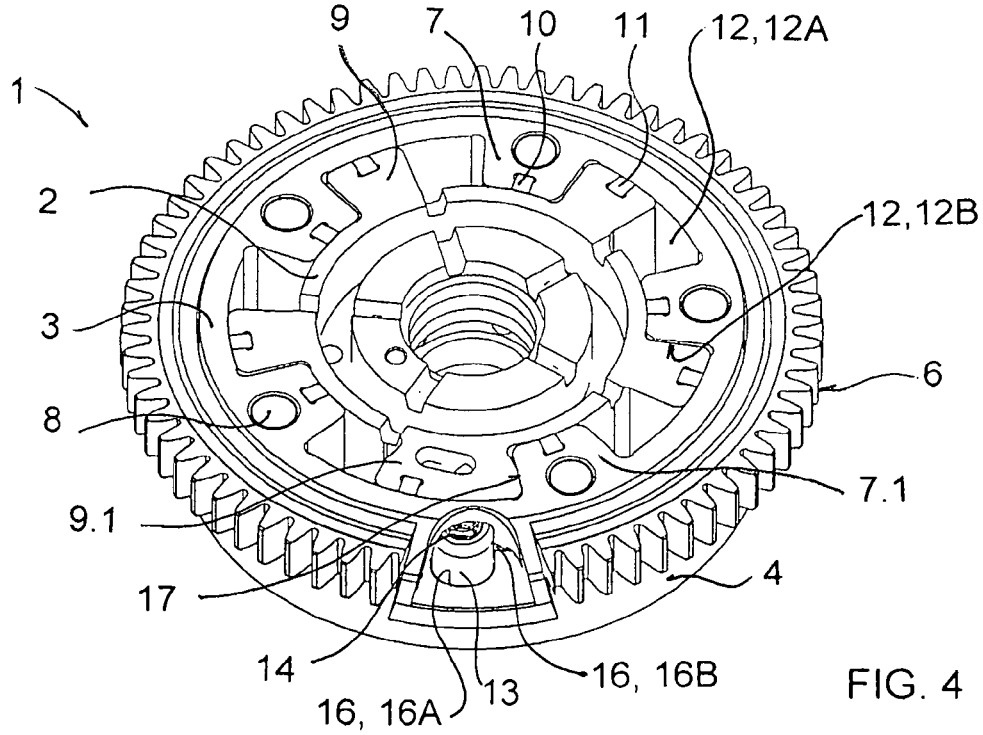
FIG. 4 shows the camshaft adjuster according to FIG. 3, in which the bolt is rotated onto an installation stop in the cavity by joint rotation of the inner body and the outer body in relation to the drive wheel.
Figure 5:
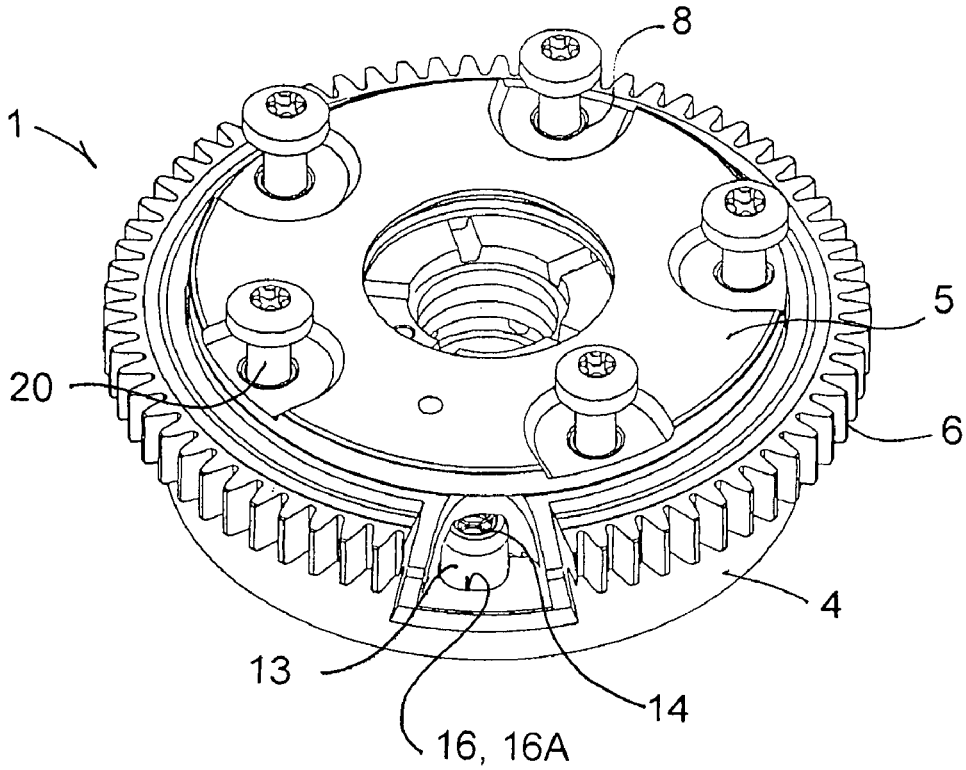
FIG. 5 shows the camshaft adjuster according to FIG. 4, in which a second cover is placed onto the camshaft adjuster.

FIGS. 1 to 10 show a hydraulic camshaft adjuster 1 for adjusting a camshaft (not illustrated) in relation to a crankshaft (likewise not illustrated) of an internal combustion engine. According to FIG. 1, the camshaft adjuster 1 has two transmission parts 2, 3 which can be rotated relative to each other for the adjustment, an inner body 2 connected in a rotationally fixed manner to the camshaft, and an outer body 3 mounted rotatably with respect to the camshaft. The transmission parts 2, 3 are arranged between a first cover 4 (FIG. 2) and a second cover 5 (FIG. 5). The outer part 3 is connected in a rotationally fixed manner to the first cover 4, which is in the form of a drive wheel, the drive wheel 4 having, on its outer circumference, a gear structure 6 which is either formed integrally with the drive wheel 4 or is separate and is connected fixedly to the drive wheel 4, via which the camshaft is driven by the crankshaft of the internal combustion engine. As an alternative to this, the gear structure 6 may also be arranged directly on the outer body 3. Instead of the toothed wheel drive indicated and discussed here, other drive connections, such as toothed belt drives or chain drives, may be provided.

Figure 1:
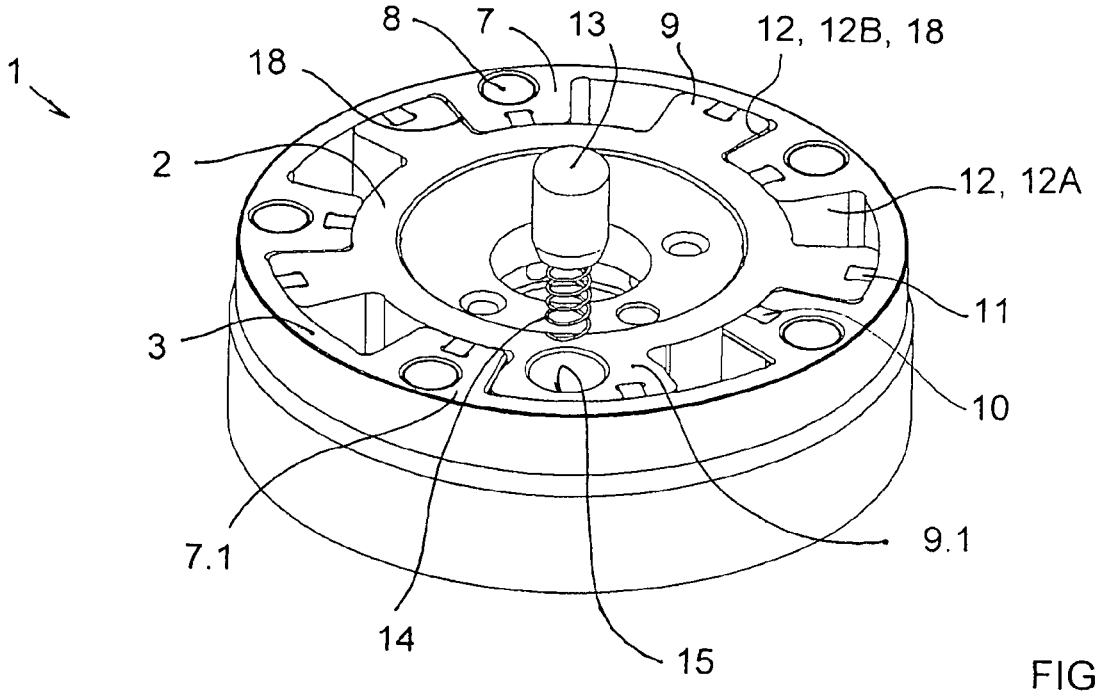
FIG. 1 shows a view from above of the camshaft adjuster according to the invention with an inner body arranged in an outer body and a locking device, in which a locking bolt and a compression spring are introduced into a bore, with the bodies being at a base stop.

According to FIG. 1, the sleeve-shaped outer body 3 which surrounds the camshaft has inwardly projecting blades 7, 7.1 which have bores 8 for receiving fastening screws. The inner body 2 which is fastened in a rotationally fixed manner to the camshaft has outwardly projecting mating blades 9, 9.1. Both the blades 7 of the outer body 3 and the mating blades 9 of the inner body 2 respectively have at least one seal 10, 11 on their circumferences. The inner body 2 and the outer body 3 together with the two covers 4, 5 form at least one hydraulic medium chamber 12 which is divided by the particular mating blade 9, 9.1 into two working chambers 12*a* and 12*b*, only one gap (FIG. 3) of the working chamber 12*b* being visible in the illustrated position of the camshaft adjuster 1.

In order to be able to transmit the driving torque of the crankshaft to the camshaft, the inner body 2 of the camshaft adjuster 1 is connected, as already mentioned, in a rotationally fixed manner to the camshaft. The driving torque is introduced by the outer body 3 into the camshaft adjuster 1 and is transmitted via the working chambers 12*a*, 12*b* to the inner body 2. The phase position between outer body 3 of the camshaft adjuster 1 and camshaft can be adjusted by varying the hydraulic medium filling of the working chambers 12*a* and 12*b*. A control valve (not illustrated here) controls the hydraulic medium supply to the camshaft adjuster 1 and therefore the phase position or the changing thereof.

The camshaft adjuster has a locking mechanism which can be acted upon hydraulically and comprises bolt 13 and compression spring 14. The locking mechanism provides for a fixed connection between inner body 2 and outer body 3 by axial movement of the bolt 13. The bolt hole which is preferably arranged in a blade 9.1 of the inner body 2 and into which the bolt 13 is introduced together with the spring 14 is denoted by the numeral 15. The spring 14 being supported, in the case of a bolt hole 15 designed as a blind hole bore, on one side on the bottom of the bolt hole 15 and on the other side on the end side of the bolt 13. In the case where a bolt hole 15 is designed as a continuous bore closed by a cover, the spring 14 is supported, on the one hand, on the cover and, on the other hand, on the bolt 13. According to FIGS. 3 to 7, the drive wheel 4, which is in the form of a cover, has a cavity 16 in which the bolt 13 engages in the locked state. The cavity 16 is formed in one of the two covers 4, 5 depending in each case on the configuration of the locking device, the cavity 16 either being fastened as a separate part to the cover 4, 5 or being molded into the cover 4, 5, i.e. being formed integrally with the cover 4, 5. According to FIG. 10, the cavity 16 has a cross section 16*a* for receiving the bolt 13 and a cross section 16*b* designed as a release channel. In order to release, i.e. to eliminate, the fixed connection between inner body 2 and outer body 3, the bolt is acted upon by a pressure medium in a specific manner so as to counteract the spring force via the release channel 16*b* so that an adjustment procedure can be initiated.

Figure 8:
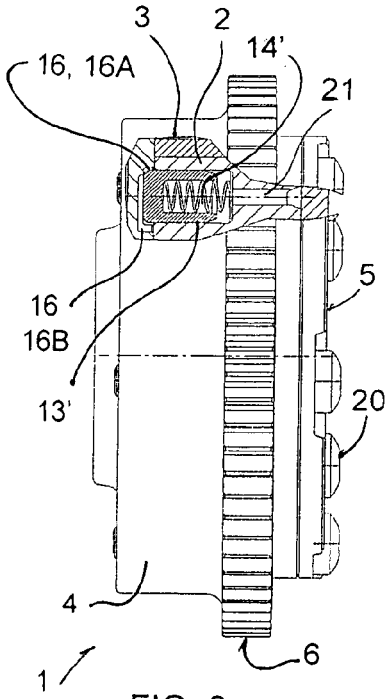
FIG. 8 shows the camshaft adjuster in a side view with a partial section in the region of the locking device.
Figure 9:
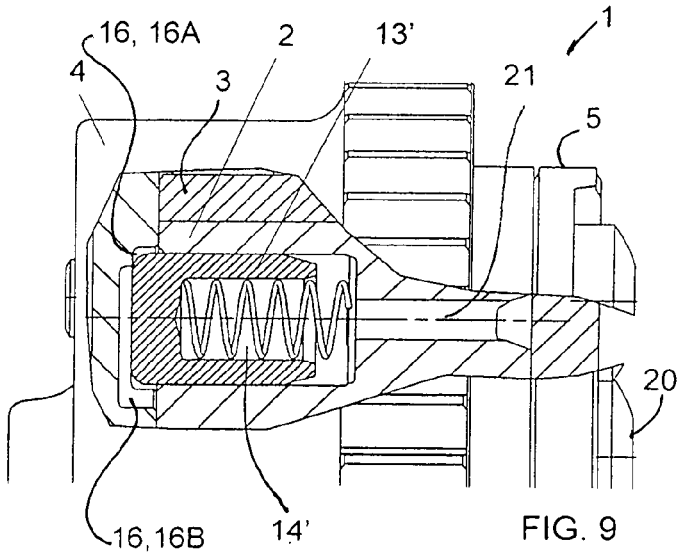
FIG. 9 shows the partial section in an enlarged illustration.

FIGS. 8 and 9 show a further refinement of the locking device, in which the bolt 13' arranged in the bolt hole 15' is designed in the manner of a cup and accommodates at least part of the compression spring 14' in its interior. At an end disposed opposite the cavity 16, the bolt hole 15' has a release bore 21.

FIGS. 1 to 6 show the assembly of the hydraulic camshaft adjuster 1. The view from above according to FIG. 1 shows the inner body 2 disposed with one of its mating blades 9.1 at the stop of a locking position 17 and the outer body 3 disposed with one of its blades 7.1 abutting the stop. The locking position 17 can be seen clearly in FIGS. 3 and 4, since (only here) blade 7.1 and mating blade 9.1 bear against each other while a gap 18 can be seen between the remaining pairs of blade/mating blade. The base stop 17 prevents an undesired movement of the camshaft adjuster 1 if there is no pressure medium pressure present. The bolt 13 is introduced together with the compression spring 14 into the bolt hole 15 which is arranged in the inner body 2 and is a blind hole bore, with first the compression spring 14 and subsequently the bolt 15 being inserted, as a result of which the compression spring 14 bears against the bottom of the blind bore 15. The camshaft adjuster 1 is still situated here in a released position.

Figure 2:
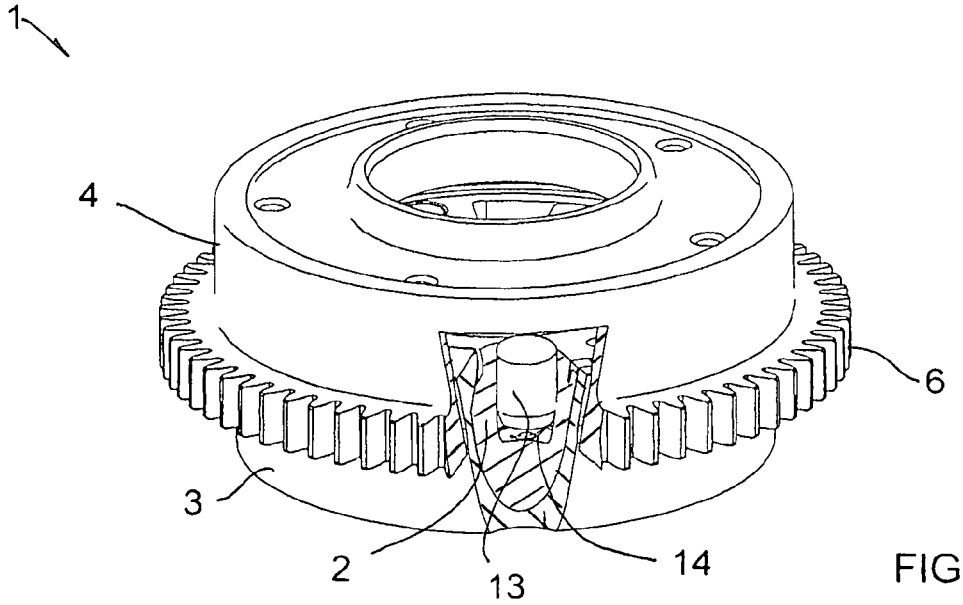
FIG. 2 shows the camshaft adjuster according to FIG. 1, in which a drive wheel in the form of a first cover and provided with a gear structure on its outer circumference is placed onto it.

According to FIG. 2, the drive wheel which in the form of a first cover 4 is subsequently placed on with its gear structure 6 arranged on the outer circumference, the camshaft adjuster 1 still being in the released position.

The view from below according to FIG. 3 shows that, after the drive wheel 4 has been placed on, the bolt 13 is introduced into the cavity 16 by rotating the drive wheel 4 in the clockwise direction or counterclockwise, with the camshaft adjuster 1 now being in a preliminarily locked position.

Figure 6:
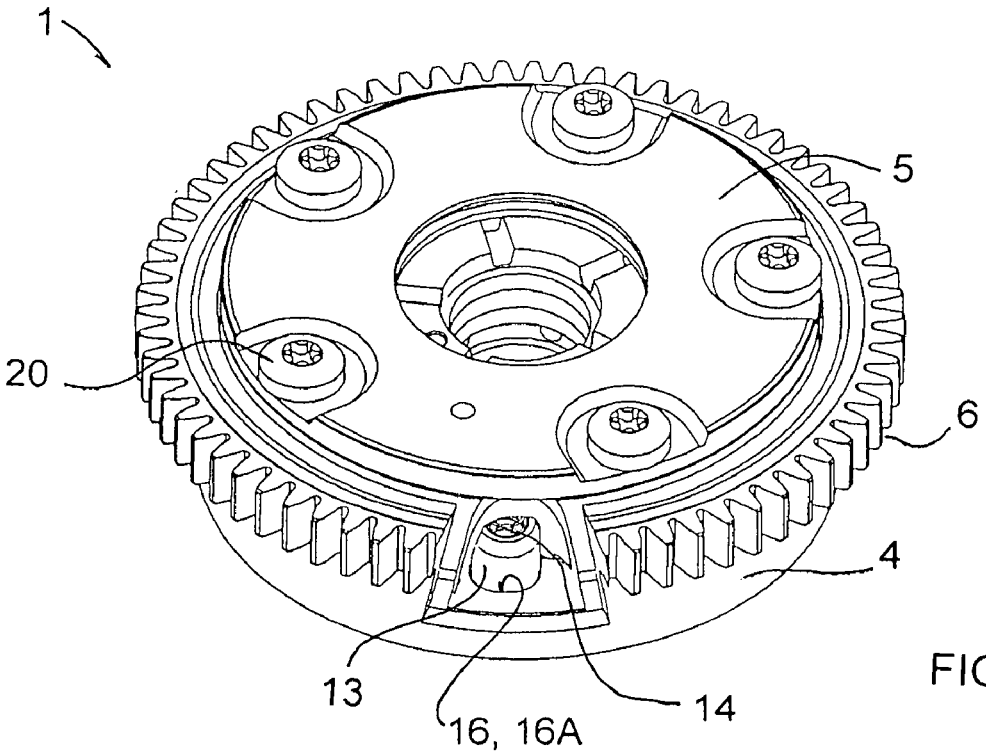
FIG. 6 shows the camshaft adjuster according to FIG. 5 with a second cover screwed onto the camshaft adjuster.
Figure 10:
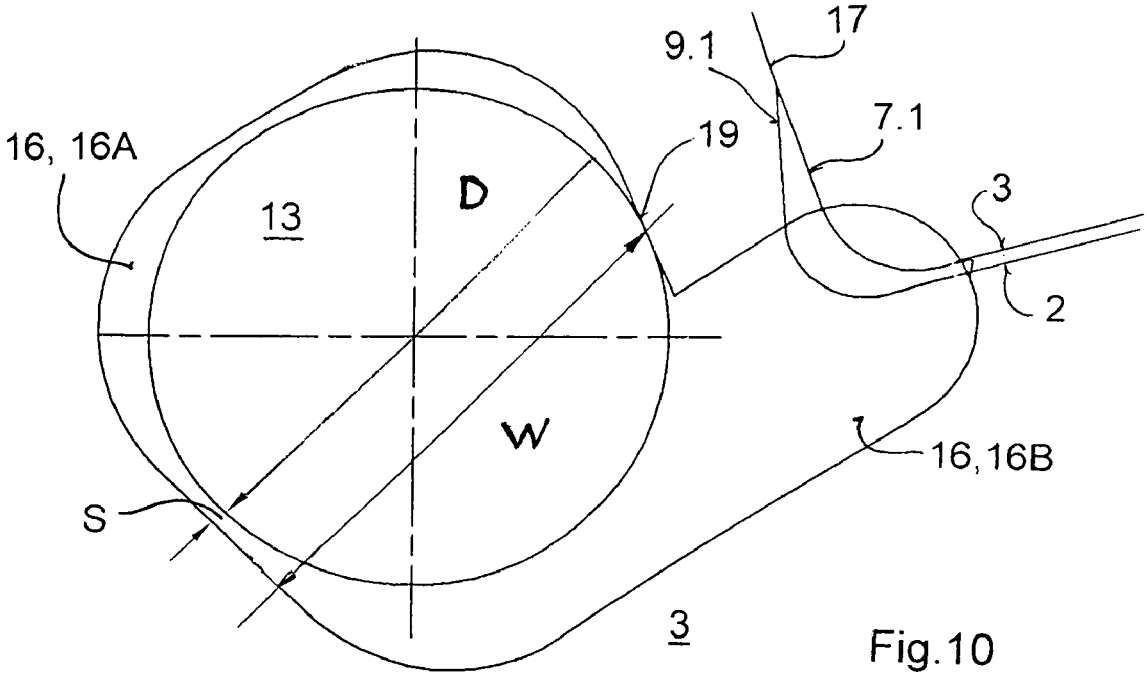
FIG. 10 shows the locking gate.

According to FIG. 4, the bolt 13 in the assembly including the inner body 2 and the outer body 3 is now rotated in relation to the drive wheel 4 (counterclockwise) onto an installation stop 19, which is visible in FIG. 10, and is held by the spring pressure of the compression spring 14. In this position, the camshaft adjuster 1 is in a finally locked position and the second cover 5 can be positioned in accordance with FIG. 5 by fastening screws 20 being inserted through the bores 8 and screwed to the inner body 2. FIG. 6 shows the screwed cover 5 and therefore the "fixing" of the assembly state.

In the case of this locking device, the maximum possible locking play S is primarily formed by the clearance width W in the cavity 16*a* minus the diameter D of the bolt 13. Shape and position tolerances of the components and the centering accuracy also have an effect on the locking play. The installation stop 19 is designed in such a manner that, during installation, the inner body 2 is rotated with the locking bolt 13 onto the installation stop 19 and at the same time the inner body 2 and the outer body 3 are disposed at the common stop, the base stop 17. This ensures that, from this position, the locking play S is predominantly formed only by the distance between the two stops 17 and 19.

Figure 7:
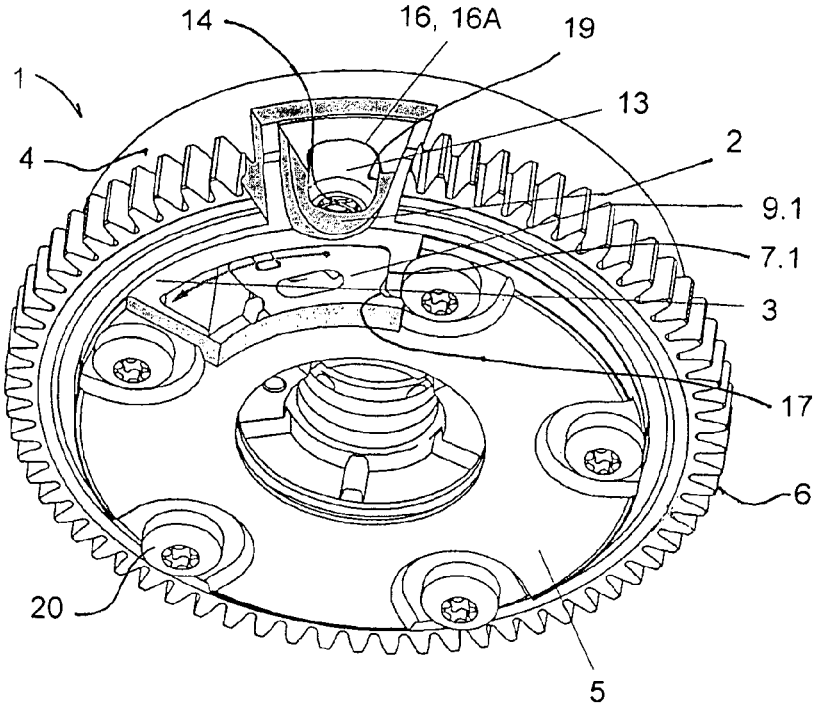
FIG. 7 shows the camshaft adjuster in a locked position, the camshaft adjuster being illustrated broken open in the region of the locking device.

FIG. 7 shows the camshaft adjuster according to FIG. 6 but in an inverted position, with the region of the locking device being illustrated broken open for better understanding. As already mentioned above, the inner body 2 and the outer body 3 sit on the common base stop 17 and the bolt 13 bears against the installation stop 19. The inner body 2 can now be rotated in the counterclockwise direction by the locking play S, which means that the camshaft adjuster 1 can already be locked before the inner body bears against the base stop 17.

What is claimed is:

1. A hydraulic camshaft adjuster (1) for a camshaft of an internal combustion engine, comprising: an inner body (2) which is connected to the camshaft in a rotationally fixed manner and has outwardly extending blades (9, 9.1), an outer body (3) which extends around the inner body and is rotatable with respect to the inner body and the camshaft and has inwardly extending blades (7, 7.1) mating with the outwardly extending blades (9, 9.1) so as to form at least one hydraulic medium chamber (12) between adjacent blades and two cover plates (4, 5) disposed at opposite sides of the inner body (2) and the outer body (3) and, upon complete assembly, firmly engaging the outer body (3), a driving connection from a crankshaft to the camshaft extending to one of the cover plates (4) and the outer body (3), and a locking device which locks the inner body (2) in relation to one of the cover plates (4) and the outer body (3) including at least one locking bolt (13) which is movably disposed in an opening (15) formed in the inner body (2) for engagement in a locking cavity (16) in one of the two cover plates (4, 5), the outer body (3) with the inwardly extending blades (7, 7') being rotationally adjustably supported between the two cover plates (4, 5), the blade (9, 9.1) of the inner body (2) of the camshaft adjuster (1) having a base stop (17), and the locking cavity (16) formed in the one cover plate (4) additionally having an assembly stop (19).

2. The hydraulic camshaft adjuster as claimed in claim 1, wherein the assembly stop (19) acts in the direction of the base stop (17).

3. The hydraulic camshaft adjuster as claimed in claim 1, wherein the locking cavity (16) is arranged in one of the cover plates (4, 5).

4. The hydraulic camshaft adjuster as claimed in claim 1, wherein the locking cavity (16) is arranged in the cover plate (4) forming a drive wheel.

5. The hydraulic camshaft adjuster as claimed in claim 4, wherein the cross section (16*a*) of the locking cavity (16) for receiving the bolt (13) is trapezoidal or it has parallel engagement walls.

6. The hydraulic camshaft adjuster as claimed in claim 1, wherein the locking cavity (16) has a cross section (16*a*) sized for receiving the locking bolt (13) and a cross section (16*b*) forming a pressure medium release channel.

7. The hydraulic camshaft adjuster as claimed in claim 6, wherein the bolt (13) can be acted upon by a pressure medium in order to be released by pressure medium supplied via the release channel (16*b*) for disengaging the locking bolt (13) from the locking cavity (16).

8. The hydraulic camshaft adjuster as claimed in claim 1, wherein the locking cavity (16) has a hard or hardened material wall.

9. The hydraulic camshaft adjuster as claimed in claim 8, wherein a hard or hardened bushing is disposed in the cross sectional area (16*a*) formed by the locking cavity.

10. The hydraulic camshaft adjuster as claimed in claim 1, wherein the maximum locking play (S) is provided essentially by the clear width (W) in the cavity (16*a*) minus the diameter (D) of the bolt (13).

11. A method for installing a hydraulic camshaft adjuster (1) for a camshaft of an internal combustion engine, the camshaft adjuster comprising an inner body (2) connected to the camshaft in a rotationally fixed manner and having outwardly projecting blades (9, 9.1) and an outer body (3) supported, upon assembly of the adjuster, rotatably with respect to the camshaft and having blades (7, 7.1) projecting inwardly into spaces between the outwardly projecting blades (9, 9.1), the inner and outer bodies (2, 3) being arranged between first and second cover plates (4, 5) connected to the outer body (3), the inner body (2) being lockable in relation to one of the cover plates (4, 5) by at least one locking bolt (13) which is mounted in the inner body (2) and extends into a locking cavity (16) formed in the one cover plate and having an assembly stop (19) in one of the cover plates (4, 5), the camshaft adjuster (1) further having a base stop (17) where an outwardly projecting blade (9, 9.1) abuts an adjacent inwardly extending blade (7, 7.1), said method comprising the steps of moving, during assembly, the inner body (2) with the locking bolt (13) received in the locking cavity (16) of the one cover plate (4, 6) onto the base stop (17) of the inwardly extending blade (7, 7.1) of the outer body (3) with the locking bolt (13) in contact with the assembly stop (19) arranged in the locking cavity (16) and then joining the first and second cover plates (4, 5) with the outer body (3) firmly engaged therebetween.

12. The method as claimed in claim 11, wherein in the position of the locking bolt (13) on the assembly stop (19) and the inner body (2) and the outer body (3) on the base stop (17), a locking play (S) is formed by a clear width (W) in the locking cavity (16) minus the diameter (D) of the locking bolt (13).

13. The method as claimed in claim 11, wherein, for installation, the components (2, 3, 4) of the preassembled camshaft adjuster (1) are positioned in such a manner that the mating blade (9.1) of the inner body (2) and the blade (7.1) of the outer body (3) are disposed adjacent the base stop (17) and at the same time the bolt (13) abuts in the locking cavity (16) of the assembly stop (19), this state being fixed by the cover (5) plates (4) being bolted together.

14. The method as claimed in claim 11, comprising the following steps: for assembly a) moving the inner body (2) with its mating blade (9.1) into contact with the base stop (17) so that the outer body (3) is with its blade (7.1) in contact with the base stop (17), b) introducing the locking bolt (13) and the compression spring (14) into the bolt hole (15) arranged in the inner body (2), c) placing the first cover plate (4), which is in the form of a drive wheel, onto the inner body and the outer body (2, 3), d) causing the locking bolt (13) to enter the cavity (16) by rotating the drive wheel (4) backward or forward, e) rotating the locking bolt (13) together with the inner body (2) and the outer body (3) in relation to the drive wheel (4) so as to engage the assembly stop (19) in the locking cavity (16), f) placing the second cover plate (5) onto the inner and outer bodies (2, 3) and, in this position, g) screwing the second cover plate (5) to the first cover plate (4) of the camshaft adjuster (1) to firmly engage therebetween the outer body (3) with the inwardly projecting blades (7, 7.1).

* * * * *